US006612712B2

(12) United States Patent
Nepil

(10) Patent No.: US 6,612,712 B2
(45) Date of Patent: Sep. 2, 2003

(54) LIGHTING SYSTEM AND DEVICE

(76) Inventor: James Nepil, 100 Maple St. #37, Garfield, NJ (US) 07026

( * ) Notice: Subject to any disclaimer, the term of this patent is extended or adjusted under 35 U.S.C. 154(b) by 0 days.

(21) Appl. No.: 10/005,761

(22) Filed: Nov. 12, 2001

(65) Prior Publication Data

US 2003/0090893 A1 May 15, 2003

(51) Int. Cl.[7] ..... F21V 33/00

(52) U.S. Cl. ..... 362/101; 362/318; 362/806; 362/96

(58) Field of Search ..... 362/318, 201, 362/96, 235, 800, 806, 102, 101

(56) References Cited

U.S. PATENT DOCUMENTS 4,916,352 A * 4/1990 Haim et al. ..... 313/25

5,890,794 A * 4/1999 Abtahi et al. ..... 362/294

* cited by examiner

*Primary Examiner*—Sandra O'Shea
*Assistant Examiner*—Guiyoung Lee
(74) *Attorney, Agent, or Firm*—Troutman Sanders LLP; Ryan A. Schneider, Esq.

(57) ABSTRACT

The present invention is a light-producing technology exemplified by lighting that is safe, reliable, energy efficient, long lasting, and capable of operating under a wide range of weather and other conditions. The device incorporates a durable housing, a light element, a liquid solution, and a power supply. Subject only to its power source, it is capable of indefinitely producing intensely visible light at 100 yards or more during both daytime and nighttime. It can be configured for higher or lower intensities in a wide variety of foreseen applications. The device is not flammable, explosive, or toxic, and without loss of function withstands shock, extended water immersion, and heating and cooling to temperatures below freezing and approaching boiling.

20 Claims, 1 Drawing Sheet

LIGHTING SYSTEM AND DEVICE

1. Field of the Invention

The present invention relates generally to a novel lighting technology, and a lighting device incorporating such technology. The lighting device is a fluid-filled, hand-held signal light that is safe, durable, and energy efficient. The present lighting device lends itself to a wide spectrum of indoor and outdoor applications.

2. Description of Related Art

Lighting devices are known that are used for both aesthetic and utilitarian purposes. Lighting devices conventionally comprise a housing containing a light element, a power source for the light element, and a medium through which the light travels from the light element to the exterior of the housing. For example, in a flashlight, the light element is a light bulb, the power source a couple of batteries, and the medium is air between the light bulb and the clear plastic cover.

Many of the prior art lighting devices suffer from limitations, including that such devices are incapable of producing intensely visible light from many yards away, and that the few devices that are capable of producing such illumination are not durable or energy efficient. Bulbs bum out, batteries weaken, water shorts electrical components, and housings break easily when dropped or jarred.

Specific prior art is discussed below, and the art generally categorized into three groups. Some lighting devices utilize a light-emitting diode as the light element, while others immerse the light element in a fluid. The addition of a fluid to a lighting device not only adds to its durability, but the fluid also promotes an even distribution of light. The following groups of prior art are the permutations of lighting devices with and without the light element being a light-emitting diode, and lighting devices with and without the medium being a fluid.

A. Non-LED Lighting Devices Lacking Fluid

U.S. Pat. No. 2,611,019 to Warner discloses a device for a multicolored hand-held signal light. This device is designed for attachment to a flashlight. It illuminates a translucent tube with selectively visible multicolored light from an incandescent white light source. It features a mechanism for changing light colors. The bulb is mounted in an opaque section of the housing resulting in low light intensity. U.S. Pat. No. 4,345,305 to Kolm discloses a portable electronic safety flare system comprising a high-intensity signal strobe visible up to two miles. A transparent tube contains a xenon strobe light, circuit board, and two AA batteries as the power supply.

The device of U.S. Pat. No. 4,967,321 to Cimock is a flashlight wand designed as a children's toy. The wand contains two DC batteries, a small incandescent bulb, and light reflecting objects. Light production of the Cimock device is limited. U.S. Pat. No. 5,392,203 to Harris, Jr. discloses a waterproof taxi light to guide aircraft on a tarmac. The device includes a lighted signal member with an elongate, translucent tubular member adapted for providing both daytime and nighttime illumination. The light source is a DC battery powered flashlight bulb. The translucent tube provides for light dispersion. Harris, Jr. discloses the use of a clear fluid within the translucent tubular member (column 6, lines 10–15), but the light element, a bulb, is not even partially submerged in the fluid. Thus, the light is not as intense as it could be if the light element were at least partially submerged in the fluid.

B. Non-LED Lighting Devices with Fluid

U.S. Pat. No. 4,070,777 to Lo Giudice discloses a novelty display device incapable of producing intensely visible light. Designed for amusement, this device uses miniature lamps strung through the length of a liquid-filled housing to illuminate a continuous flow of bubbles through a liquid contained within a hollow glass tube. Boiling liquid heated by lighted bulbs is the bubble source. The device is not only an inadequate means of producing high intensity lighting, but it is also not durable because the glass housing will likely shatter if dropped. U.S. Pat. No. 4,271,458 to George, Jr. discloses decorative light tubing for lighted tube displays. The device comprises a flexible tube containing a dielectric fluid (such as mineral oil or glycerin) and low voltage filament bulbs. However, this device is incapable of producing high-intensity lighting.

U.S. Pat. No. 4,600,974 to Lew et al. discloses an optically decorated light baton with multiple purposes similar to the present prototype. It is a portable light tube with reflective platelets suspended in a medium, and in one embodiment phosphorescent or fluorescent material coats the light-emitting tube. The device of U.S. Pat. No. 5,165,781 to Orak is a novelty flashlight with color producing chambers intended for use as a toy or amusement. It comprises a low heat generating filament bulb and colored-fluid-containing transparent cups mounted to a power receiving housing. The light is not intensely visible because the bulb is at one end of the housing, which itself lacks fluid. The device requires continuous agitation to swirl the liquid colors. Although the housings of these two devices are fluid-filled, the light is not intensely visible partly because the light sources are located at only one end of the device where there is no fluid. Furthermore, although both devices utilize fluid mediums, both require agitation to obtain the full effect of the fluid: the Orak device requires agitation to swirl the liquid colors and the Lew et al. device requires agitation to make the light reflecting particles move through the fluid.

U.S. Pat. No. 5,662,406 to Mattice discloses a lighted baby bottle designed for easy location in the dark. A filament bulb produces a low intensity glowing light and some heat. U.S. Pat. No. 5,993,021 to Lin discloses a decorative lamp designed for aquarium accent lighting. A tube containing water and artificial fish is illuminated by a low-intensity, heat-producing filament bulb not immersed in the fluid. A bubble valve produces air bubbles which cause the artificial fish to move.

C. Lighting Devices Employing LEDs

U.S. Pat. No. 4,070,784 to Yokogawa et al. discloses an electric fishing float designed for nighttime visibility. The upper section of the tubular float contains LEDs or a miniature incandescent bulb and the lower section contains energizing cells not immersed in fluid. U.S. Pat. No. 5,036,442 to Brown discloses an illuminated, waterproof signal device. Its tubular wand contains a power source, circuit board, switch, compressible spring to maintain electrical contact, and a plurality of incandescent or LED (preferred) light sources.

U.S. Pat. No. 5,697,695 to Lin et al. discloses a hand-held signal stick designed to flash different colored light signals in a particular sequence. The tubular device contains batteries, a circuit board, a plurality of LEDs usually of different colors connected between positive and negative wire rods, and an LED selector switch. Although this device is capable of producing visual signals of a particular light and of flashing color signals in a predetermined sequence, connecting the LEDs to wire rods is not as stable as connecting the LEDs to the structure of the device. Thus, this device is not durable as a blow to the signal stick can disconnect one of the connections. Finally, the device of U.S. Pat. No. 5,865,524 to Campman is a durable, submersible hand-held light wand designed for visual signaling. Its tubular translucent housing has egg-shaped ends to withstand pressures at great depths. The housing contains multicolored LED light sources connected to a power source by magnetic switches and resistor elements, operated by a rotating ring switch containing a magnetic portion.

Therefore, it can be seen that a need still exists in the lighting system art for a safe, reliable, durable, long lasting, and energy-efficient device that produces intensely visible light of controllable intensities under a wide variety of outdoor and indoor circumstances and conditions. It is to such a lighting device that the present invention is primarily directed.

BRIEF SUMMARY OF THE INVENTION

Briefly described, in a preferred form, the present invention comprises a new light-generating technology, and lighting devices that incorporate the technology. The light-generating technology incorporates the use of a fluorescent dye dissolved in a fluid medium that at least partially surrounds the light element. The preferred lighting device utilizing this lighting principal comprises a durable housing, a light element, a power source for the light element, and a lighting fluid at least partially surrounding the light element.

The device is lightweight, safe, durable, long lasting, and energy efficient. The present lighting device incorporates the following characteristics, among others, which distinguish the invention from the prior art: (a) the new lighting principle—fluorescent dye dissolved in a fluid medium; (b) high energy efficiency—high light intensities generated by low power (AC or DC); (c) long operational life—subject only to power supply, light emission continues indefinitely without chemical breakdown or materials fatigue; (d) adjustable light intensity—by composition of the fluid medium and control of the power source; (e) simple construction—few parts to fail; and (f) durable construction—water-submersible and shock-proof, virtually unbreakable in normal use.

In a preferred form, the housing is columnar and has two releasably secured sections: a gripping section and a light-emitting section. The gripping section contains two 1.5 volt DC batteries for energizing the LEDs of the lighting elements. At the base of the gripping section is a recessed rotary switch that enables the user to turn the device on and off.

The light-emitting section comprises an LED secured to the housing and at least partially submerged in a lighting fluid. In a preferred form, the device comprises four LEDs for sufficient light intensity, and the lighting fluid comprises a solution of approximately 10 ml water, 7 ml of 80 proof vodka as a non-toxic ethanol source, and 5 ml of water-soluble, non-toxic, fluorescent color from Createx Colors of East Granby, Conn. The lighting fluid preferably fills approximately ⅞ths of the light-emitting section, leaving approximately $\frac{1}{8}^{th}$ of the section as air space. Coolants of the lighting fluid can be other than alcohol, for example de-icing fluid Types 1 and 4. While these are toxic, they can be used with or without aqueous dilution with water. It will be understood by those of skill in the art that ingredient concentrations can vary to produce different effects and intensities, although some combinations may have disadvantageous effects. For example, as more color is used, the more likely it is to adhere to the LEDs, causing a rise in temperature.

Fewer or more than four LEDs may be used. More would generate higher light intensities for such applications as stop lights, brake lights, flashing signs and the like, while fewer would produce lower intensities suitable more for room lighting, outdoor lights, night lights, key chains, indicator lights to operate under extreme conditions, personal safety devices and tracking devices. Further, infrared LEDs provide military and governmental applications such as targeting, tracing, tracking and night vision. The uses and flexibility of the present device and its underlying technology are virtually endless.

The housing of one preferred embodiment is approximately fourteen inches long, of which the gripping section is approximately six inches and the light-emitting section approximately eight inches. In this embodiment, the housing diameter is roughly one inch, and incorporates a nearly uniform cross-section along its length.

The device is highly durable because in the preferred form the light elements are fixedly secured to the housing. This greatly reduces the chance of disabling one of the connections, or enabling the LEDs to wobble loosely within the housing. In addition, the present invention is unbreakable under normal conditions. In testing of a prototype, it was found to withstand the shock of being dropped from six feet in height, and functioned indefinitely with undiminished intensity while immersed in water.

The present invention is superior to prior art devices in numerous ways. The following examples are specific distinguishing features of the present invention and the above-described prior art. The present invention differs from the Harris, Jr. light in its use of LEDs in a fluorescing fluid as an integral part of a lighting principle. The Harris, Jr. device is not submergible, nor as durable as the present invention. The present devices differ from that of Harris, Jr. in that their body is filled with a mixture of ethanol, water, and fluorescent dye, and has LEDs as the light source. The LEDs are pushed to a controllably higher voltage limit than they were designed for because the fluid serves as a coolant in addition to dispersing the light. The filament bulb of the Harris, Jr. device draws high power vs. that of the present devices' LEDs, but emits a much lower intensity of usable light. Compared to light bulbs, LEDs are less subject to breakage in use and have a far longer life span. In fact, the design of the present invention was prompted by use of a Harris, Jr. type device under harsh airport conditions where it failed under temperature extremes, and broke when dropped or exposed to vibration. Harris, Jr. discloses that a clear liquid could be used in its fluidless device, but the reason for this is unclear as the bulb of Harris, Jr. would fail under immersion. Finally, the Harris, Jr. design has limited use, not the broad applications foreseen for the technology of the present application.

The Lew et al. device differs from the present invention in having incandescent vs. LED light sources, reflective platelets in the medium, a phosphorescent or fluorescent surface coating (if present) vs. dissolved in the fluid, and it must be agitated or mixed during use to make the light reflecting particles move through the medium. Further, only low light intensities are generated.

Thus, an object of the invention is to provide an improved lighting device embodying a new lighting principle extendable to a wide range of outdoor and indoor lighting applications.

Another object of the present invention is to provide a lighting device that has an adjustable light intensity yet visible from over 100 yards away.

A further object of the present invention is to provide a safe, reliable, durable, long lasting, and virtually unbreakable lighting device.

Another object of the present invention is to provide a lightweight device.

An object of the present invention is to disclose a new lighting principle—fluorescent dye dissolved in a fluid medium;

Yet another object of the present invention is to provide a lighting device with high energy efficiency—high light intensities generated by low power (AC or DC).

Further objects of the present invention are to provide a lighting device that has a long operational life—subject only to power supply; whose light emission continues indefinitely without chemical breakdown or materials fatigue; that is simple to construct with few parts to fail; and that is durable—water-submergible and shock-proof—virtually unbreakable in normal use.

These and other objects, features and advantages of the present invention will become more apparent upon reading the following specification in conjunction with the accompanying drawing figures.

DETAILED DESCRIPTION OF A PREFERRED EMBODIMENT

Figure 1:
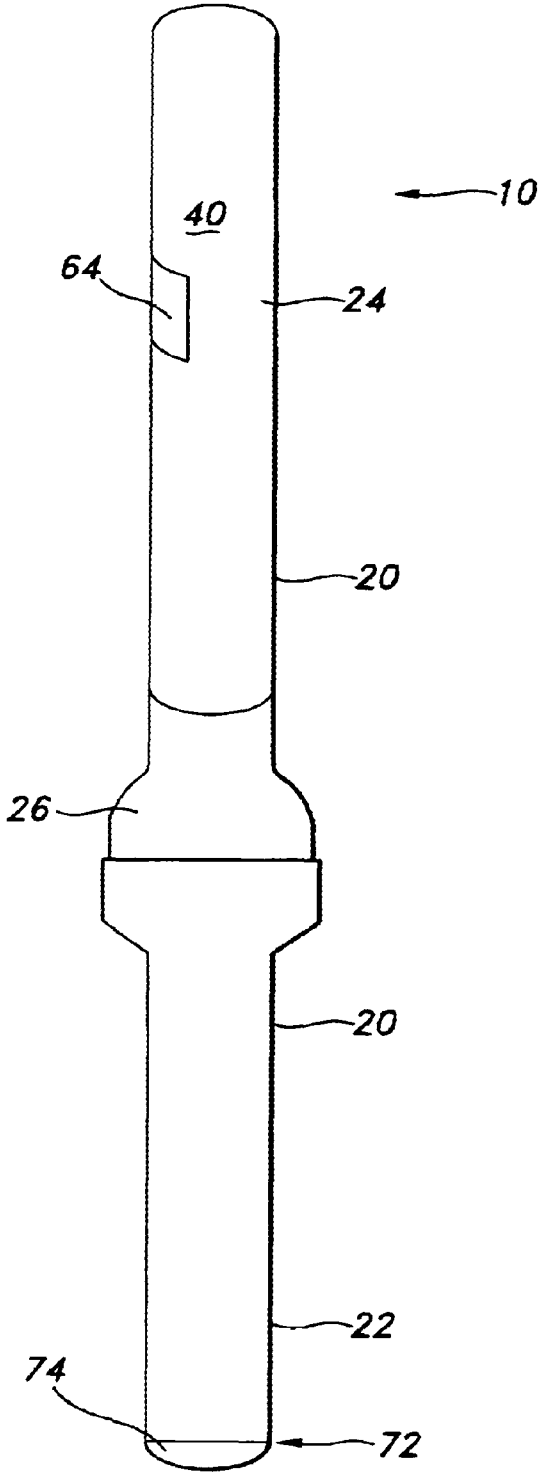
FIG. 1 is a side-view of a preferred embodiment of the present invention.
Figure 2:
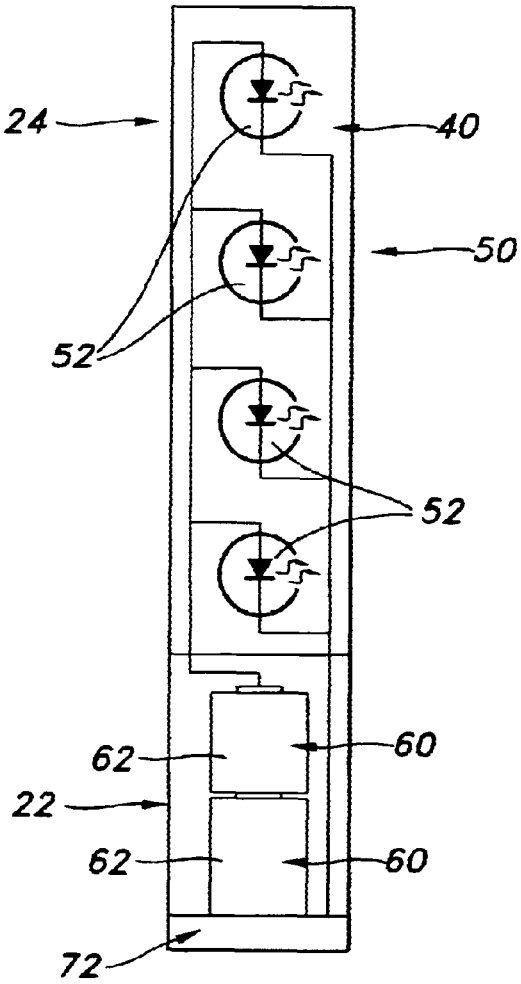
FIG. 2 is an electrical schematic of the invention of FIG. 1.
Figure 3:
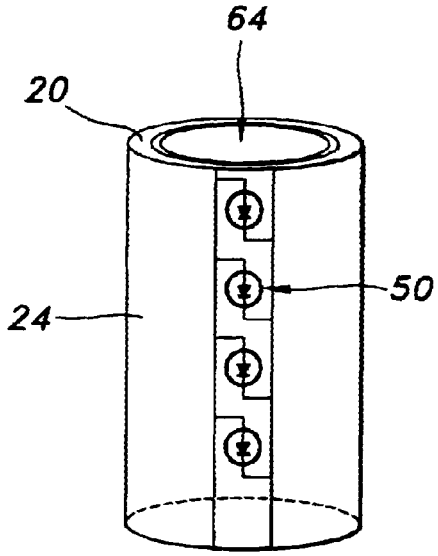
FIG. 3 is a perspective view of the light elements of FIG. 2 fixedly connected to the housing of the invention.

Referring now in detail to the drawing figures, wherein like reference numerals represent like parts throughout the several views, FIGS. 1–3 illustrates a preferred embodiment of the present invention 10. As shown, the present invention 10 comprises a housing 20, lighting fluid 40 carried within the housing 20, a light element 50 immersed in the lighting fluid 40, and a power source 60 to energize the light element 50. The present invention 10 is preferably lightweight and portable.

In a preferred embodiment, the housing 20 is a unitary columnar assembly formed of a durable, lightweight and water-resistant material that can withstand shock if dropped. The assembly has at least one section 24 through which light can pass, and wherein the material of this section preferably is not adversely affected by gas, oil, ether, or most other organic solvents. One such material is plastic. In one preferred embodiment, the housing 20 comprises a food grade plastic. Alternatively, as will be understood by those of skill in the art, the housing 20 can comprise acrylics, polystyrenes, cellulose acetates, cellulose butyrates, ionomers, polycarbonates, or medium-impact styrenes. Vinyls are not recommended as they dissolve when exposed to most solvents. The material forming other sections of the housing need not enable light to pass therethrough, and can be plastic, rubber, metal, or wood, among other materials.

While the housing 20 can be a unitary columnar assembly, it can, alternatively, be formed of other shapes including, but not limited to, conical, tubular, globular, or obelisk. Alternatively, the housing 20 need not be fully unitary and can comprise separately releasable or fixedly connected sections, preferably at least two sections: a gripping section 22 and a light-emitting section 24.

The unitary construction is preferred for such features as sealing and durability. However the gripping section 22 and light-emitting section 24 can be releasably secured to one another such that the two sections 22, 24 can be detached and reattached. In one embodiment, the two sections 22, 24 are threadably secured to one another. However, they can be fitted together in other manners such as being secured with screws, twisting together and locking in place, sliding together and snapping in place. Yet a third section 26 can be used as a connecting element for releasably or fixedly securing the two sections 22, 24 together.

The lighting device can further comprise a medium of lighting fluid 40 contained within the housing 20. The lighting fluid 40 beneficially is a stable, non-toxic, non-combustible, non-explosive liquid that will not interact with the housing such to cause it disrepair. Additionally, the lighting fluid 40 preferably will wash out of clothing before drying. Due to freezing point depression by solutes, the freezing point of the preferred fluid 40 is below zero degrees F. In a prototype of the present invention, as the boiling point of the fluid 40 was approaching 190 degrees F., glue used to secure the housing began to melt. Yet at both temperature extremes, from <0 to 190 degrees F., the light element 50 did not fail or dim. Those skilled in the art will understand those materials, for example, glycol, salt and isopropyl alcohol, among others, that can be used to extend the ranges of thermal tolerance in different applications.

In one preferred embodiment, the lighting fluid 40 is a solution often (10) parts of water, seven (7) parts of 80-proof vodka, and five (5) parts of water-soluble, non-toxic, fluorescent color from Createx Colors. However, the concentrations can be varied. Alternatively, as will be understood by those of skill in the art, other materials such as glycol, salt, and isopropyl alcohol can be used. Preferably, the lighting fluid 40 contains no particulate matter so the emitted light is not reflected or refracted in the lighting fluid 40. However, the lighting fluid 40 can contain other material, whether soluble or not. Alternatively, the lighting fluid 40 can be other gaseous or liquid substance or any combination of such substances that provide some element of durability to the device 10 and/or additional luminosity. The lighting fluid 40 preferably fills ⅞ths of the light-emitting section 24, leaving ⅛th as air space. However, these proportions can be varied.

As illustrated in FIG. 2, the lighting device further comprises a light element 50. In a preferred embodiment, a durable element such as a light-emitting diode 52 (LED 52), is used. Alternatively, the light element 50 can be a light bulb, infrared LED, or any other light source that can be at least partially submerged in lighting fluid 40. The light element 50 and lighting fluid 40 preferably do not react during normal operation so as to combust or explode. In the preferred form the device 10 is explosion proof and completely spark proof.

The lighting device can further comprise a power source 60 for energizing the light element 50. In a preferred embodiment, the power source 60 comprises two 1.5 volt DC batteries 62. Alternatively, the power source 60 is not limited to DC power and can be AC, solar, or other types of power sources.

In a preferred embodiment, the present device 10 comprises a plurality of light elements 50, for example, four LEDs 52 that are connected in parallel (as shown in FIGS. 2 and 3) and are secured to the light-emitting section 24 of the housing 20. Fewer or more than four light elements 50 can be used. More can generate higher light intensities for applications such as stop lights, brake lights, and flashing signs. Fewer can produce lower intensities suitable for applications such as room lighting, outdoor lights, night lights, key chains, indicator lights to operate under extreme conditions, personal safety devices, and tracking devices. Infrared LEDs can be used in devices for military and governmental applications such as targeting, tracing, tracking, and night vision.

The LEDs 52, which are energized by the two 1.5 volt DC batteries 62 that are located within the gripping section 22 of the housing 20, are hard-connected to the surface of the light-emitting section 24, for example, at positions 64 shown in FIGS. 1 and 3. In a preferred embodiment, the LEDs 52 are arranged in a vertical line, but the light elements 50 can be configured in a number of ways. Alternatively, the light elements 50 can be suspended through the fluid 40 or attached to any other component on the housing 20 such that they are not susceptible to thrashing within the section 24. In a preferred embodiment, the light-emitting section 24 sealably contains the lighting fluid 40 that surrounds the LEDs 52 such that they are at least partially submerged. Preferably, light element 50 is filly submerged in the lighting fluid 10.

The invention 10 can further comprise an on/off switch 72, preferably a recessed rotary switch 74 to prevent accidental activation, located at the base of the gripping section 22. Other switch types can be used, such as a push-button switch or a toggle switch. A dimmer switch can be used to adjust the light intensity of the present device 10. If such a switch is used with LEDs, a variable resistor should be connected to the LEDs.

The invention 10 can further comprise a carrying assembly (not shown). The carrying assembly is used to carry the device and can comprise, for example, a strap, a rope, a ring, a handle, a wristband, or a belt-clip.

The invention 10 can also be configured to use rechargeable batteries with an adapter to be plugged into an AC power source.

In a second preferred embodiment, the device 10 is constructed for interior room lighting. This embodiment employs two LEDs, a much larger volume of the lighting fluid 40 than the first preferred embodiment, and is powered by 120 volt AC through a 3 volt DC transformer. An on/off electrical switch is used to turn the device on and off. The LEDs alone do not provide much usable light, but when at least partially submerged in the lighting fluid 40 adjustable intensities suitable for prolonged room lighting are produced. Intensities can be varied using fixed resistors or variable adjustable types. This second preferred embodiment can illuminate a 9'×12' room in total darkness with enough light for reading and seeing objects in very good detail.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A lighting device comprising:

(a) a light-emitting section through which visible light can pass;

(b) a medium carried by the light-emitting section; and (c) a light element at least partially submerged in the medium, wherein the medium includes fluorescent color dye.

2. The lighting device of claim 1, wherein the medium is a fluid comprising water, a coolant, and the fluorescent color dye.

3. The lighting device of claim 2, wherein the light element is fixedly secured in the fluid.

4. The lighting device of claim 3, wherein the light element is an LED.

5. The lighting device of claim 1, wherein the medium is a fluid wherein the fluorescent color dye is dissolved in the fluid medium, and wherein the fluid medium at least surrounds the light element.

6. A lighting device comprising:

a light-emitting section through which visible light can pass;

a fluid carried within the light-emitting section; and a light element at least partially submerged in the fluid and fixedly secured to the light-emitting section;

wherein the fluid incorporates approximately ten pans water, approximately seven parts coolant, and approximately five parts soluble color dye.

7. The lighting device of claim 6, wherein the light-emitting section is releasably securable to a gripping section, and further comprising a power source for the light element, the power source residing in the gripping section.

8. The lighting device of claim 6 further comprising light intensity adjustability.

9. The lighting device of claim 6, wherein the coolant is selected from the group consisting of ethanol and dc-icing fluid Types 1 and 4, and wherein the color dye is fluorescent dye.

10. The lighting device of claim 6, wherein the fluid is a stable, non-toxic, non-combustible, non-explosive liquid that will nor interact with the light-emitting section such to cause it disrepair.

11. The lighting device of claim 6, the light element selected from the group consisting of LEDs, infrared LEDs and bulbs.

12. The lighting device of claim 6, wherein the light element is fully submerged in the fluid.

13. A method of lighting an area with visible light comprising the following steps:

(a) at least partially submerging a light element in a medium contained within a light-emitting section of a housing, the light-emitting section of the housing enabling visible light to pass there through;

(b) fixedly securing the light element in the medium; and (c) energizing the light element, wherein the medium includes fluorescent color dye.

14. The method of lighting according to claim 13, wherein the medium is a fluid comprising water, a coolant, and the fluorescent color dye.

15. The method of lighting according to claim 14, wherein the fluid is a stable, non-toxic, non-combustible, non-explosive liquid that will nor interact with the light-emitting section such to cause it disrepair.

16. The method of lighting according to claim 14, wherein the fluid comprises approximately ten parts water, approximately seven parts coolant, and approximately five parts soluble fluorescent color dye.

17. The method of lighting according to claim 13, wherein the light element is an LED.

18. The method of lighting according to claim 13 further comprising the step (d) of adjusting the light intensity to the desired intensity.

19. The method of lighting according to claim 16, wherein the coolant is selected from the group consisting of ethanol and de-icing fluid Types 1 and 4.

20. The method of lighting according to claim 13, wherein step (a) includes fully submerging the light element in the medium.

* * * * *